United States Patent [19]

Okada

[11] 4,349,269

[45] Sep. 14, 1982

[54] MANUAL PAPER FEED INHIBITING DEVICE IN ELECTROGRAPHIC COPYING MACHINE

[75] Inventor: Osamu Okada, Toyokawa, Japan

[73] Assignee: Minolta Camera Kabushiki Kaisha, Osaka, Japan

[21] Appl. No.: 231,573

[22] Filed: Feb. 3, 1981

[30] Foreign Application Priority Data

Feb. 15, 1980 [JP] Japan ..... 55-18646[U]
Dec. 18, 1980 [JP] Japan ..... 55-182698[U]

[51] Int. Cl.[3] ..... G03G 15/00

[52] U.S. Cl. ..... 355/14 SH; 355/3 SH; 355/3 FU; 355/14 FU; 432/4; 432/11; 432/35; 271/256; 271/262; 271/263

[58] Field of Search ..... 355/14 SH, 14 FU, 3 SH, 355/3 FU, 3 TR, 14 TR, 30; 430/130; 432/4, 10, 11, 12, 34, 35; 219/216; 271/256, 262, 263

[56] References Cited

U.S. PATENT DOCUMENTS 2,641,997 6/1953 Butterfield et al. ..... 355/14 R
2,857,682 10/1958 Olden et al. ..... 355/14 R X
4,008,957 2/1977 Summers ..... 355/14 R
4,078,166 3/1978 Kitamura et al. ..... 219/216
4,145,599 3/1979 Sakurai et al. ..... 219/216
4,267,434 5/1981 Simpson ..... 219/216 X

*Primary Examiner*—Arthur C. Prescott
*Attorney, Agent, or Firm*—Wenderoth, Lind & Ponack

[57] ABSTRACT

An electrophotographic copying machine comprises at least one paper supply unit from which a copying is automatically supplied towards a processing station, a manual feed mouth through which a copying paper is manually inserted into the machine, an electrophotographic processing unit for forming thermally fusible powder image on the copying paper, and a heat-fixing device for fusing and fixing the powder image on the copying paper. This machine is provided with a manual paper feed inhibiting device operable in such a manner the manual feed of the copying paper through the manual feed mouth is permitted only when and after the heat fixing device has attained the predetermined high temperature.

11 Claims, 5 Drawing Figures

MANUAL PAPER FEED INHIBITING DEVICE IN ELECTROGRAPHIC COPYING MACHINE

BACKGROUND OF THE INVENTION

The present invention generally relates to an electrophotographic copying machine having a manual paper feed capability and, more particularly, to a manual paper feed inhibiting device in the electrophotographic copying device.

An electrophotographic copying machine having normal or automatic paper feed and manual paper feed capabilities and operable selectively in one of normal and manual feed modes is currently commercially available. In such copying machine, when the machine is in the normal feed mode, a copying paper in the form of either a single sheet of paper or a web of paper from a roll is automatically supplied from at least one paper supply unit towards a processing station. On the contrary, when the machine is in the manual feed mode, a copying paper usually in the form of a single sheet of paper is manually supplied through a feed mouth towards the processing station.

It has often occurred, or the necessity has often occurred that, when the machine is operating in the manual feed mode, the user of the machine manually supplies a copying paper which may be either identical in quality and size to or different from that standardized for the machines of the same brand or the same make.

In any event, the operation of the machine on the copying paper whether fed automatically during the normal feed mode or manually during the manual feed mode remain the same.

In the known copying machine of the type referred to above and disclosed, for example, in the U.S. Pat. No. 4,113,374, patented on Sept. 12, 1978, the invention of which has been assigned to the same assignee of the present invention, an arrangement has been made to interrupt the continued supply of the copying paper toward the processing station by means to interrupt the rotation of the feed rollers and/or to light a warning lamp to provide a visual indication to inhibit the manual paper feed when and so long as the next succeeding copying operation can not readily be initiated. The provision of the manual paper feed inhibiting device of this kind is effective to avoid any possible erroneous use of the copying machine and to assure a smooth and satisfactory copying operation being performed in the machine.

However, it has been found that fixing of a toner or powder image transferred onto a copying paper of relatively large thickness, such as Bristol board, tends to result in defects. This is because the heat fuser used in a fixing device in the copying machine is heated only to the predetermined temperature necessary to fuse toner particles on the one hand and because the thick copying paper has a larger heat capacity than that of the copying paper of relatively small thickness. In other words, although the fixing device used in the known electrophotographic copying machine is effective to fuse and then fix the powder image transferred onto the copying paper standardized for the machine the only predetermined temperature to which the heat fixing device has been heated is insufficient to fuse the powder image transferred onto copying paper of relatively large heat capacity greater than the standardized paper.

SUMMARY OF THE INVENTION

Accordingly, the present invention has been developed with a view to substantially eliminating the above described disadvantages and inconveniences inherent in the prior art electrophotographic copying machine and has for its essential object to provide an improved electrophotographic copying machine having the normal and manual paper feed capabilities, which is effective to fuse and fix the powder image transferred on the copying paper, substantially irrespective of the heat capacity of such copying paper.

Another important object of the present invention is to provide an improved copying machine of the type referred to above which is reliable in operation and easy to handle.

In order to accomplish these and other objects, the present invention provides an electrophotographic machine of the type referred to above with a manual paper feed inhibiting device which comprises means for inhibiting the manual feed of the copying paper through the manual feed means, switching means for selecting one of a plurality of copying papers of different thickness and a control means for adjusting the temperature of the heat fixing device to a predetermined high temperature when a copying paper of relatively large thickness is selected and copying paper of relatively small thickness has previously been used and to a predetermined low temperature when a copying paper of relatively small thickness is selected and copying paper of relatively large thickness has previously been used, respectively, and also for bringing the inhibiting means into operation during the time the temperature adjustment is being performed in the heat fixing device.

BRIEF DESCRIPTION OF THE DRAWINGS

These and other objects and features of the present invention will become apparent from the following description taken in conjunction with a preferred embodiment thereof with reference to the accompanying drawings, in which.

DETAILED DESCRIPTION OF THE EMBODIMENT

Figure 1:
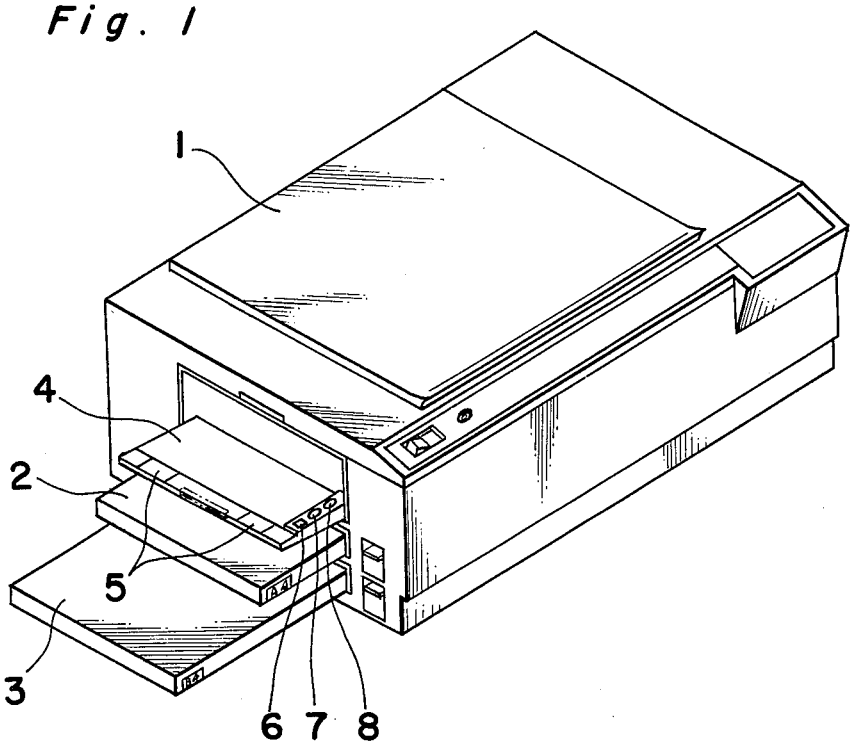
FIG. 1 is a perspective view of an electrophotographic copying machine.

Before the description of the present invention proceeds, it is to be noted that like parts are designated by like reference numerals throughout the accompanying drawings. It is also to be noted that in the manual feed mode, the user manually supplies a copying paper which may be either identical in quality and size to or different from that standardized for the machine. Therefore, throughout the specification, the term "the copying paper" is used for all of the above described papers. Where copying paper of relatively large thickness and standardized copying paper whose thickness is relatively small are used for copying, it is described as such.

Referring first to FIG. 1, there is shown an electrophotographic copying machine which utilizes a warning lamp 8 as a means for inhibiting a manual feed of a copying paper into the machine. The copying machine illustrated in FIGS. 1 to 3 comprises a housing 1 having first and second feed mouths defined in one end wall thereof for accommodating first and second paper cassettes 2 and 3 for different paper size, each cassette 2 or 3 containing therein a stack of sheets of copying of uniform and standardized size. In the same end wall of the housing 1 where the first and second feed mouths are defined, the housing 1 also has a third mouth defined therein for receiving a copying paper that has been fed manually, and a pivotally supported feed table 4 pivotable between blocking and receiving positions as will be described later. The feed table 4 has metal pieces 5 rigidly secured to a free end of said table 4 remote from the point of pivot of said table 4 and also has at one side portion thereof an actuator switch 6, a signaling lamp 7 which is lit when the actuator switch 6 is turned on, and a warning lamp 8. The switch 6 is operated, that is, turned on, when a manual feed mode is desired, to cause a heat-fixing device 19 which will be described later to be heated to a predetermined high temperature necessary to fuse and fix powder images on a copying paper of relatively large thickness. On the contrary, when the switch 6 is turned off, the temperature of the heat-fixing device 19 is controlled to a predetermined low temperature from the predetermined high temperature to fuse and fix the powder images on a standardized copying paper. The signaling lamp 8 when lit provides a visual indication that the heat-fixing device 19 is not yet ready for fixing the powder images on the copying paper, that is, the temperature of the heat-fixing device 19 has not yet reached the predetermined high or low temperature.

Figure 2:
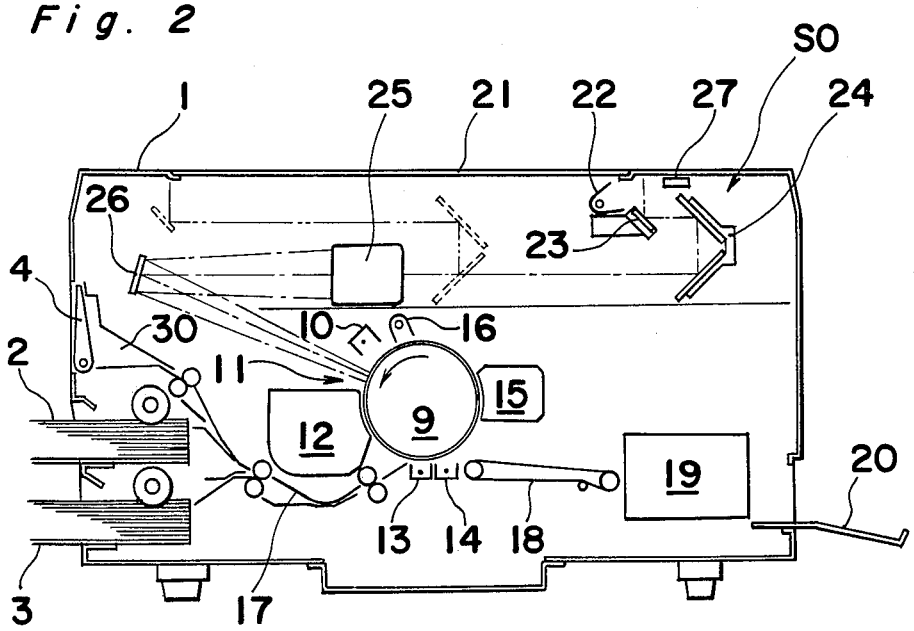
FIG. 2 is a schematic side sectional view of the machine of FIG. 1.

FIG. 2 is a schematic side sectional view of the copying machine. As shown this machine includes, within its housing 1, a photoreceptor drum 9 supported for rotation in one direction shown by the arrow, and an electrostatic charger 10, an image projecting system 11, a developing device 12, a transfer charger 13, a separating charger 14, a cleaner unit 15 and an eraser lamp 16, all being of any known construction and arranged around and adjacent the outer peripheral surface of the photoreceptor drum 9 in the order given above. The machine also includes a paper feed passage 17 extending between the feed mouths and the proximity of the transfer charger 13, and a conveyor belt 18 extending between the proximity of the separating charger 14 and the heat-fixing device 19.

In accordance with the present invention, the heat-fixing device 19 is of a type which can be heated to two predetermined temperatures, a predetermined low temperature T1 which is attained thereby when the standardized copying paper is utilized, and the predetermined high temperature T2 which is attained thereby when the actuator switch 6 is turned on, that is, when sheets of non-standardized copying paper fed manually through the third feed mouth one at a time are utilized. This heat-fixing device 19 is to be understood as having a temperature sensor Th (see FIG. 4) built therein, said temperature sensor being operable to detect the actual temperature to which the heat-fixing device 19 is being heated and to supply an output signal indicative of such actual temperature of the heat-fixing device 19 to a microcomputer COM, which will be described later, so that the temperature of the heat-fixing device 19 can be controlled to either one of the predetermined low and high temperatures and, also, the warning lamp 8 can be deenergized when the heat-fixing device 19 attains either one of the predetermined low and high temperatures.

The copying paper having the powder image fixed thereon by the heat-fixing device 19 is ejected onto a storage tray 20 from which it can be removed from the housing 1. The housing 1 has at its top an original support 21 for the support of an original to be copied, the image projecting system being located substantially below the original support 21. This image projecting system comprises an illuminating lamp 22, for illuminating the original placed on the support 21 a first reflective mirror 23 fast with the illuminating lamp 22, a second reflective mirror assembly 24, a projecting lens assembly 25 and a third reflective mirror 26. The machine as illustrated is of a type wherein the optical system SO including the lamp 22, and the first and second mirror assemblies 23 and 24 is movable underneath the original support 21 to scan the original on the support 21. The rays of light carrying the image of the original so scanned are projected onto the photoreceptor drum 9. Because it is of this type, the machine housing 1 carries a position detecting switch 27 for detecting whether the optical system SO is held at a start position shown by the solid lines in FIG. 2 or departed from the start position towards a scanned position as shown by the broken lines in FIG. 2, an electric signal from said switch 27 being supplied to the microcomputer COM, as will be described later so that the warning lamp 8 can be lit when and so long as the optical system SO is not held at the start position.

When the copying machine of the construction described above is operated, the photoreceptor drum 9 rotates in the direction of the arrow. As the drum 9 rotates, the photoreceptor surface on the drum 9 is electrostatically charged by the charger 10 and is then exposed to the incoming light projected through the projecting system 11 to form an electrostatically charged latent image complemental in shape to the image of the original so projected. The projection of the image of the original on the support 21 onto the charged photoreceptor drum is carried out sequentially in synchronism with the scanning motion of the optical system SO as is well known to those skilled in the art. The latent image on the photoreceptor drum 9 is subsequently developed by the developing device 12 to form a visible powder image, which is thereafter transferred by the transfer charger 13 onto the copying paper. After the transfer of the powder image onto the copying paper, the latter is separated by the separating charger 14 from the photoreceptor drum 9 and fed towards the heat-fixing device 19 by means of the conveyor belt 18. As the copying paper having the transferred powder image thereon enters the heat-fixing device, the powder image is heat-fused and is therefore fixed on the copying paper which is thereafter ejected onto the storage tray 20. On the other hand, the photoreceptor drum 9 still continues to rotate and during this rotation, the photoreceptor drum 9 is cleaned by the cleaner 15 and is then erased by the eraser lamp 16 in readiness for the subsequent copying operation. The details of the structure and function of the copying machine so far described are well known to those skilled in the art.

Figure 3:
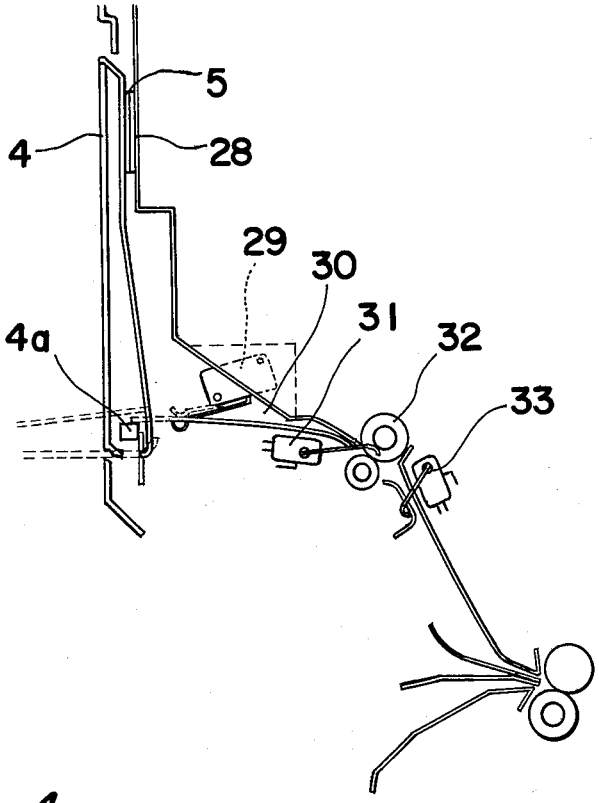
FIG. 3 is a schematic side sectional view of a manual paper feed table and its associated parts according to the present invention.

FIG. 3 illustrates, in side sectional view, the pivotally supported feed table 4 and its associated parts. As best shown in FIG. 3, the feed table 4 is pivotable about a shaft 4*a* between the blocking and receiving positions and is pivoted about the shaft 4*a* to the receiving position, in the manner shown in FIG. 1 and as shown by the broken lines in FIG. 3, when and so long as the copying paper is manually fed, i.e., inserted through the third feed mouth. However, when and so long as the copying paper is fed from either one of the paper cassettes 2 and 3, the feed table 4 is held at the blocking position as shown by the solid lines in FIG. 3 with the metal pieces 5 magnetically attracted by magnets 28 secured to the adjacent end wall of the housing 1.

Reference numeral 29 employed in FIG. 3 designates a detector switch for detecting whether the feed table 4 is in the blocking position or in the receiving position. This detector switch 29 is used to selectively bring the machine into a normal feed mode or the manual feed mode. The manual feed mode is defined as the mode wherein the machine is operable with the copying paper being fed manually through the third feed mouth, and the normal feed mode is defined as the mode wherein the machine is operable with the standardized copying paper being fed from either one of the paper cassettes 2 and 3.

Referring to FIG. 3, the third feed mouth through which the copying paper sheets are manually fed one at a time is communicated to the paper feed passage 17 through a guide passage 30 by way of a pair of feed rollers 32, one of said feed rollers 32 being operatively coupled to a drive unit (not shown) in any known manner while the other thereof is an idler roller. Operatively associated with the feed rollers 32 is a first control switch 31 for controlling the rotation of the feed rollers 32 during the period in which the copying operation is possible. Operatively associated with the guide passage 30 and positioned on one side of the feed rollers 32 opposite to the control siwtch 31 is a second control switch 33 operable to energize the warning lamp 8 and also to cause the optical system SO to undergo its scanning operation. Electric output signals from the switches 29, 31 and 33 are all supplied to the microcomputer COM as will be described later.

Figure 4:
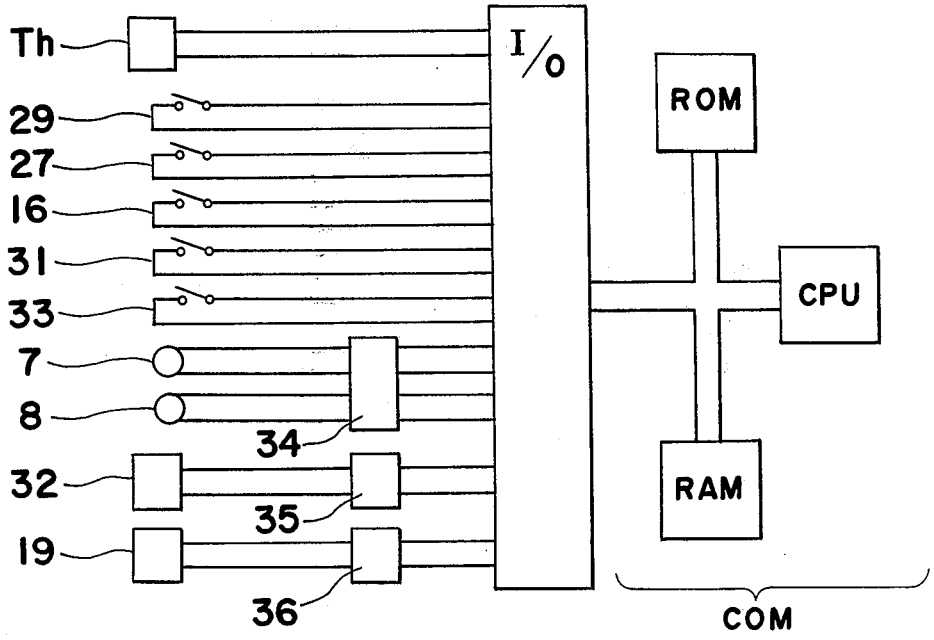
FIG. 4 is a circuit block diagram showing connection of a manual feed inhibiting device of the present invention with a microcomputer used in the copying machine.

FIG. 4 illustrates a circuit arrangement wherein the microcomputer COM used to control the sequential operation of the copying machine is concurrently used to control the warning lamp 8 and the feed rollers 32. As shown in FIG. 4, the temperature sensor Th built in the heat-fixing device 19, the switches 29, 31 and 33 and the position detecting switch 27 (FIG. 2) are all electrically connected through an input-output control I/O to the microcomputer COM including a central processing unit CPU, a random access memory RAM, and a read-only memory ROM. The electrical signals supplied to the microcomputer COM are temporarily stored in the random access memory RAM and then compared with contents stored in the ready-only memory ROM. Depending on the results of the comparison so made, the microcomputer COM controls, through the input-output control I/O, the energization and deenergization of the lamps 7 and 8, the rotation and stop of the feed rollers 32, the temperature of the heat-fixing device 19 and other copying operations performed by the movable component parts of the copying machine. In FIG. 4, reference numeral 34 designates an electric lighting circuit for the lamps 7 and 8, reference 35 represents a drive circuit for the feed roller 32 and reference numeral 36 represents a temperature control circuit for the heat-fixing device 19.

Figure 5:
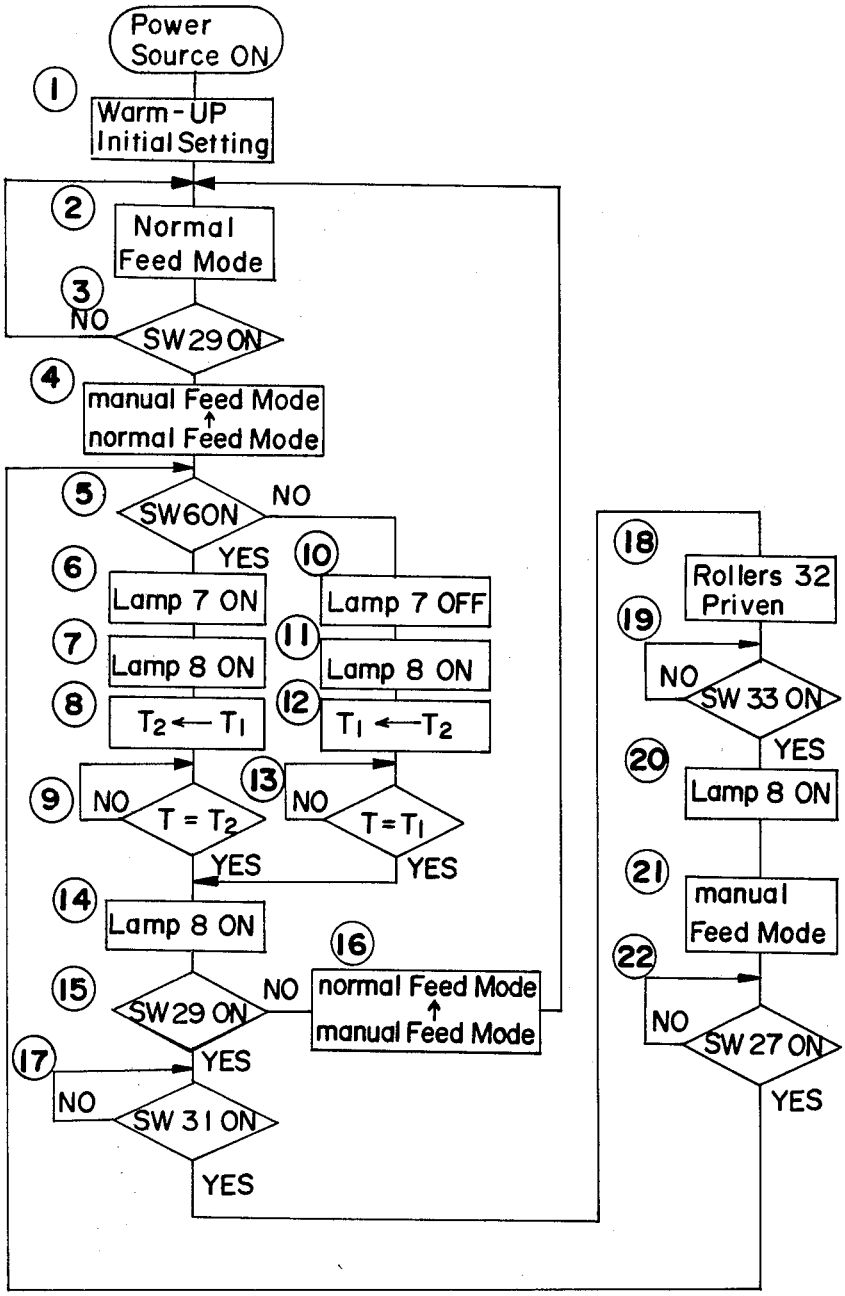
FIG. 5 is a flow chart showing the process performed by the manual feed inhibiting device.

The operation of the manual feed inhibiting device constructed as hereinbefore described in accordance with the present invention will now be described with particular reference to the flow chart shown in FIG. 5.

Assuming that the electric power source is activated, the warm-up control and the initial setting are performed in the copying machine at the stage (1). The initial setting includes the normal feed mode, that is, the selection of one of the paper cassettes 2 and 3 to be operated and the setting of the number of copies to be made which is normally one. At the stage (2) and after the completion of the warm-up, the control of the normal feed mode is carried out. The normal feed mode is initiated by turning on a "print" switch and the copying paper can be fed out of one of the paper cassettes 2 and 3 that has been brought into operation and, at the same time, the copying machine starts its operation in the manners as hereinbefore described. In the event that the feed table 4 is pivoted from the blocking position towards the receiving position during the normal feed mode, the detector switch 29 detects the movement of the feed table 4 towards the receiving position and energizes the warning lamp 8 until the optical system SO being moved towards the scanned position returns to the start position with the switch 27 consequently turned on. The lamp 8 when so lit provides a visual indication that the copying paper should not be inserted through the third feed mouth by way of the feed table 4 during the lighting of the lamp 8.

If the copying operation is not performed during the normal feed mode, at the stage (3), a check is made as to whether or not the switch 29 is turned on. If the switch 29 is found to be turned off, this means that the feed table 4 is held in the blocking position blocking the third feed mouth, and accordingly the machine is brought back to the normal feed mode. On the other hand, if the switch 29 is found to be turned on, the normal feed mode is switched over to the manual feed mode and this takes place at the stage (4). The difference in operation between the manual and normal feed modes is that, during the manual feed mode, an "ON" signal from the "print" switch is not accepted and, therefore, not only is the supply of the copying paper from either one of the cassettes 2 and 3 inhibited, but also the copying operation is initiated by the insertion of the copying paper which is detected by the first and second control switches 31 and 33 and, at the same time, the distance over which the optical system SO scans is set to the maximum available distance.

At the stage (5), a check is made as to whether or not the switch 6 is turned on, that is, whether or not the thickness of the copying paper is relatively large. If the switch 6 is found to be turned on, the lamp 7 is lit at the stage (6) and the lamp 8 is lit at the stage (7), enabling the heat-fixing device 19 to be heated from the predetermined low temperature T1 to the predetermined high temperature T2 at the stage (8). The actual control of the temperature T of the heat-fixing device 19 from the predetermined low temperature T1 to the predetermined high temperature T2 is by way of the operation of the temperature control circuit 36. At the stage (9), a check is made as to whether or not the heat-fixing device 19 has been heated to the predetermined high temperature T2. If the temperature T2 has been attained, the lamp 8 is deenergized at the stage (14).

On the other hand, if the switch 6 is found to be turned off at the stage (5), the lamp 7 if lit is deenergized at the stage (10) and the lamp 8 is lit at the stage (11), thereby enabling the temperature control circuit 36 to cause the temperature T of the heat-fixing device 19 to be lowered to the predetermined low temperature T1 at the stage (12). At the stage (13), a check is made as to whether the temperature T of the heat-fixing device 19 has attained the predetermined low temperature T1. If the temperature T has attained the temperature T2, the lamp 8 is deenergized at the stage (14).

At the stage (15), a check is made as to whether or not the switch 29 is turned on. If the switch 29 is found to be turned off, the manual feed mode is changed over to the normal feed mode at the stage (16). At the same time, if the lamp 7 has been lit, the lamp 7 is deenergized and the temperature control circuit 36 causes the heat-fixing device 19 if heated to the predetermined high temperature T2 to be cooled down to the predetermined low temperature T1. However, if the switch 29 is found to be turned on, and if the switch 31 is turned on in response to the insertion of the copying paper into the guide passage 30 at the stage (17), the feed rollers 32 are driven at the stage (18). When the feed rollers 32 are so driven in respective directions opposite to each other, the copying paper is fed further towards a gap between the transfer charger 13 and the photoreceptor drum 9 through the feed passage 17. It is, however, to be noted that if the switch 33 is turned on in response to the transportation of the copying paper past the switch 33, at the stage (19), the lamp 8 is lit at the stage (20) and the copying operation is effected at the stage (21) on the copying paper so supplied as hereinbefore described. It is also to be noted that, except when the manual feed mode requires the manual supply of the copying paper and the distance of scan of the optical system SO is set to the maximum available distance, the copying operation during the manual feed mode is identical to that during the normal feed mode.

At the stage (22), a check is made as to whether or not the switch 27 is turned on and, if the switch 27 is found to be turned off, the stage (5) is resumed in readiness for the next succeeding copying operation. The copying operation may not be completed, and the copying paper may be being transported through the heat-fixing device at the time the optical system SO has returned to the start position. However, since the next succeeding copying operation can be initiated, in a manner similar to that carried out to make a plurality of copies successively during the normal feed mode, if the optical system SO has returned to the start position, if the switch 27 is found to be turned on at the stage (22), the stage (5) is resumed. Subsequent to the stage (5), the process proceeds either to the stages (6), (7), (8) and (9) for a copying paper of relatively large thickness or to the stages (10), (11), (12) and (13) for the standardized copying paper in sequence and, finally, at the stage (14), the lamp 8 is deenergized in readiness for the next succeeding insertion of the non-standardized copying paper through the third feed mouth.

As hereinbefore described, the lamp 8 is operable during the manual feed mode and is lit when and so long as the heat-fixing device 19 has not reached the predetermined high or low temperature required to fuse and then fix the powder image on the copying paper of relatively large thickness or the standardized copying paper and, also, during the time the copying operation is being performed, that is, during the period when the next succeeding copying operation can not be initiated and before the optical system SO returns completely to the start position.

From the foregoing description, it has now become clear that the present invention involves numerous advantages. For example, even when non-standardized copying paper, that is copying paper of a thickness larger than the standardized thickness of the paper contained in the cassettes 2 and 3, is fed into the copying machine, no defect occur in fixing the powder image on the non-standardized copying paper, because the temperature of the heat-fixing device can be automatically controlled to the predetermined high temperature and the feed of such paper is inhibited until achievement of such temperature control. A similar advantage applies even where the standardized copying paper is fed into the machine from either one of the paper cassettes. In addition, since the lamp 8 is provided at a location readily perceptible by the user of the copying machine, the user can handle the apparatus comfortably.

Although the present invention has been described in connection with the preferred embodiment thereof with reference to the accompanying drawings, it is to be noted that various changes and modifications will be apparent to those skilled in the art. By way of example, although the lamp 8 has been described as employed to provide a visual indication that the copying paper can not be manually supplied, a shutter member may be employed in place of or in combination with the lamp 8 to close the third feed mouth when and so long as the copying paper can not be manually supplied.

Accordingly, such changes and modifications are to be understood as included with the true scope of the present invention as defined by the appended claims, unless they depart therefrom.

I claim:

1. In an electrophotographic copying machine having manual and normal paper feed capabilities, which machine comprises at least one paper supply unit from which a copying paper is automatically supplied towards a processing station, a manual feed means through which a copying paper is manually inserted into the machine, means for forming a thermally fusible powder image on the copying paper, and a heat-fixing device for fusing and fixing the powder image on the copying paper, the improvement which comprises a manual paper feed inhibiting device comprising switching means for causing the temperature of the heat fixing device to be adjusted to one of a plurality of predetermined temperatures in dependence on the thickness of the copying paper; means for inhibiting the manual feed of the copying paper through the manual feed means; and a control means for actuating said inhibiting means during the time the temperature adjustment is being performed in the heat fixing device in response to the switching means, whereby the manual feed of the copying paper by the manual feed means is permitted only when and after the heat fixing device has attained the predetermined temperature in dependence on the thickness of the copying paper.

2. The machine as claimed in claim 1, wherein said inhibiting means comprises a visual indicator.

3. The machine as claimed in claim 2, wherein said inhibiting means is arranged adjacent the manual feed means.

4. The machine as claimed in claim 1, wherein said switching means is arranged adjacent the manual feed means.

5. In an electrophotographic copying machine operable selectively in manual and normal paper feed modes one at a time, which machine comprises at least one paper supply unit for accommodating a stack of sheets of copying paper of uniform size and for supplying sheets of copying paper therefrom during the normal feed mode, a manual feed means through which a sheet of copying paper is manually inserted into the machine, means for forming a thermally fusible powder image on the copying paper irrespective of whether the copying paper is supplied through the supply unit or the manual feed means, and a heat-fixing device for fusing and fixing the powder image on the copying paper, the improvement which comprises a mode selector means for bringing the machine selectively into manual and normal paper feed modes one at a time; switching means for causing the temperature of the heat fixing device to be adjusted to one of two predetermined high and low temperatures in dependence on the thickness of the copying paper; means for inhibiting the manual feed of the copying paper through the manual feed means; a control means for actuating said inhibiting means during the time the temperature adjustment is being performed in the heat fixing device in response to the switching means, whereby the manual feed of the copying paper through the manual feed means is permitted only when and after the heat fixing device has attained the predetermined temperature in dependence on thickness of the copying paper.

6. The machine as claimed in claim 5, wherein said inhibiting means comprises a visual indicator.

7. The machine as claimed in claim 6, wherein said inhibiting means is arranged adjacent the manual feed means.

8. The machine as claimed in claim 5, wherein said switching means is arranged adjacent the manual feed means.

9. The machine as claimed in claim 5, wherein said manual feed means includes a feed table supported for pivotal movement between blocking and receiving positions, and wherein said mode selector means is constituted by a switch member.

10. The machine as claimed in claim 9, wherein said inhibiting means comprises a visual indicator, said visual indicator being positioned on the feed table.

11. The machine as claimed in claim 9, wherein said switching means is positioned on the feed table.

* * * * *